US009056453B2

(12) United States Patent
Houben et al.

(10) Patent No.: US 9,056,453 B2
(45) Date of Patent: Jun. 16, 2015

(54) DROPLET BREAK-UP DEVICE

(75) Inventors: Rene Jos Houben, Eindhoven (NL); Leonardus Antonius Maria Brouwers, Beesel (NL); Andries Rijfers, Kamerik (NL)

(73) Assignee: NEDERLANDSE ORGANISATIE VOOR TOEGEPAST-NATUURWETENSCHAPPELIJK ONDERZOEK TNO, Delft (NL)

( * ) Notice: Subject to any disclaimer, the term of this patent is extended or adjusted under 35 U.S.C. 154(b) by 1476 days.

(21) Appl. No.: 12/675,516

(22) PCT Filed: Sep. 1, 2008

(86) PCT No.: PCT/NL2008/050578

§ 371 (c)(1), (2), (4) Date: Mar. 19, 2010

(87) PCT Pub. No.: WO2009/028947

PCT Pub. Date: Mar. 5, 2009

(65) Prior Publication Data

US 2010/0201758 A1 Aug. 12, 2010

(30) Foreign Application Priority Data

Aug. 31, 2007 (EP) ..... 07115425

(51) Int. Cl.

| | |
|---|---|
| ***B41J 2/07*** | (2006.01) |
| ***B41J 2/02*** | (2006.01) |
| ***B41J 2/03*** | (2006.01) |

(Continued)

(52) U.S. Cl.

CPC . *B41J 2/03* (2013.01); *B05B 3/001* (2013.01); *B05B 3/1007* (2013.01)

(58) Field of Classification Search

CPC ..... B41J 2002/14193; B41J 2/14048
USPC ..... 347/48, 61–63, 70, 74, 75
See application file for complete search history.

(56) References Cited

U.S. PATENT DOCUMENTS

| | | | | |
|---|---|---|---|---|
| 3,709,432 | A | 1/1973 | Robertson | |
| 3,864,691 | A * | 2/1975 | Schroeder | 346/74.2 |
| 4,190,844 | A | 2/1980 | Taylor | |

(Continued)

FOREIGN PATENT DOCUMENTS

| | | | |
|---|---|---|---|
| EP | 0 152 200 | A | 8/1985 |
| JP | 62 083062 | A | 4/1987 |

(Continued)

OTHER PUBLICATIONS

International Search Report dated Nov. 14, 2008, for PCT/NL2008/050578.

*Primary Examiner* — Stephen Meier
*Assistant Examiner* — Renee I Wilson
(74) *Attorney, Agent, or Firm* — Leydig, Voit & Mayer, Ltd.

(57) ABSTRACT

The invention relates to a droplet break up device (1) comprising: a chamber (2) for containing a pressurized printing liquid (3) comprising a bottom plate; at least one outlet channel (4, 4') having a central axis, provided in said chamber for ejecting the printing liquid; and an actuator for breaking up, a fluid jetted out of the outlet channel. The actuator comprises a revolving, member (5) comprising a surface deformation (7, 7') shaped to provide a pressure pulse near the outlet channel. Accordingly, a simple mechanism is provided for providing multiple printing nozzles.

21 Claims, 5 Drawing Sheets

(51) Int. Cl.
*B05B 3/00* (2006.01)
*B05B 3/10* (2006.01)

(56) References Cited

U.S. PATENT DOCUMENTS

| | | | | |
|---|---|---|---|---|
| 4,341,310 | A | 7/1982 | Sangiovanni et al. | |
| 5,534,904 | A * | 7/1996 | Sheinman | 347/75 |
| 5,969,733 | A | 10/1999 | Sheinman | |
| 6,106,107 | A | 8/2000 | Sheinman | |
| 6,362,843 | B1 * | 3/2002 | Silverbrook | 347/54 |
| 6,375,088 | B1 | 4/2002 | Warrick | |
| 2002/0171716 | A1 | 11/2002 | Jeanmaire | |

FOREIGN PATENT DOCUMENTS

| | | | |
|---|---|---|---|
| JP | 04-011961 | A | 1/1992 |
| JP | 2000-033701 | A | 2/2000 |
| JP | 2002-143745 | A | 5/2002 |
| WO | WO 2004/011154 | A2 | 2/2004 |
| WO | WO 2004/018212 | A1 | 3/2004 |
| WO | WO 2006/101386 | A1 | 9/2006 |

* cited by examiner

DROPLET BREAK-UP DEVICE

FIELD OF THE INVENTION

The invention relates to a droplet break-up device, in the art also known as a drop on demand system or a continuous printing system, configured for ejecting droplets from a printing nozzle in various modes.

In this connection, by a continuous jet printing technique is meant the continuous generation of drops which can be utilized selectively for the purpose of a predetermined printing process. The supply of drops takes place continuously, in contrast to the so-called drop-on-demand technique whereby drops are generated according to the predetermined printing process.

BACKGROUND

A known device is described, for instance, in U.S. patent specification U.S. Pat. No. 5,969,733. This document discloses a so-called continuous jet printer for printing materials comprising viscous fluids. With this printer, viscous fluids can be printed. During the exit of the viscous fluid through an outlet channel, a pressure regulating mechanism provides, with a predetermined regularity, variations in the pressure of the viscous fluid adjacent the outflow opening. This leads to the occurrence of a disturbance in the fluid jet flowing out of the outflow opening. This disturbance leads to a constriction of the jet which in turn leads to a breaking up of the jet into drops. This yields a continuous flow of regressive drops with a uniform distribution of properties such as dimensions of the drops. The actuator of the regulating mechanism is provided as a vibrating plunger pin, actuated by a piezo-element. This construction is relatively expensive and difficult to upscale to multiple nozzles.

SUMMARY OF THE INVENTION

In one aspect, the invention aims to provide a break-up device that is simple in construction and can be scaled easily to multiple nozzles, to overcome the limitations of current systems.

According to an aspect of the invention, a droplet break up device is provided comprising a chamber for containing a pressurized printing liquid; an outlet channel, provided in said chamber for ejecting the printing liquid; and an actuator for breaking up a fluid jetted out of the outlet channel; wherein the actuator comprises a revolving member having a bottom surface arranged opposite the outlet channel, the bottom surface comprising a surface deformation shaped to provide a pressure pulse near the outlet channel.

According to another aspect of the invention, a method of ejecting droplets for printing purposes is provided, comprising providing a chamber for containing a printing liquid and an outlet channel in the chamber; pressurizing the liquid and imputing a pressure pulse to the liquid near the outlet channel so as to break up a fluid jetted out of the outlet channel; wherein the pressure pulse is imparted through a rotation induced jet disturbance.

Through the revolving member, a simple and effective jet disturbance can be created, which is easily scalable to multiple nozzle systems.

In addition, by virtue of high pressure, fluids may be ejected having a particularly high viscosity such as, for instance, viscous fluids having a viscosity of $300 \cdot 10^{-3}$ Pa·s when being processed. In particular, the predetermined pressure may be a pressure between up to 600 bars.

BRIEF DESCRIPTIONS OF THE DRAWINGS

Other features and advantages will be apparent from the description, in conjunction with the annexed drawings, wherein.

DETAILED DESCRIPTION OF THE DRAWINGS

Figure 1:
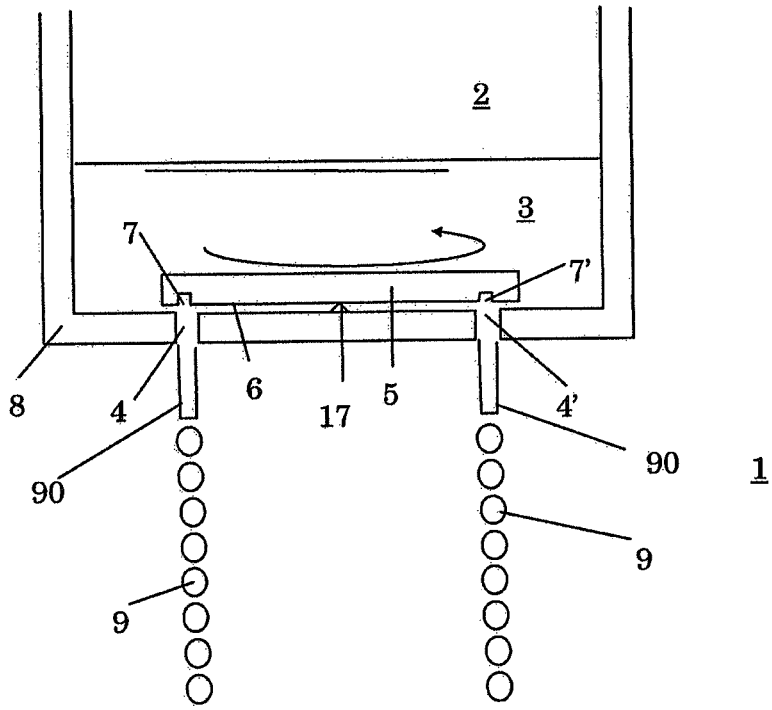
FIG. 1 shows schematically a first embodiment of a printing system for use in the present invention.

FIG. 1 shows a first schematic embodiment of a droplet break up device according to the invention.

The droplet break up device 1, also indicated as printhead, shown schematically in FIG. 1, comprises a chamber 2 for containing a pressurized printing liquid 3. The chamber may be provided with a pump for pressurizing the printing liquid or with an inlet channel for receiving pressurized liquid (not shown). In his embodiment, two outlet channels 4, 4' are provided in chamber 2. Through the outlet channels 4, 4', printing liquid is ejected in the form of droplets 9. The droplets 9 are generated by pressure pulses that are breaking up a fluid jet 90, that is jetted out of the outlet channel 4. The pressure pulses are provided by a revolving member 5, formed as an annular disk. The revolving member 5 comprises a bottom surface 6, arranged opposite the outlet channel 4. The pressure pulses are generated by movement of surface deformations 7, 7' that are comprised in the bottom surface 6. Accordingly a pressure pulse is generated near the outlet channel 4, so that the droplets 9 are formed from fluid 3. In detail, near the outlet channel a small effective volume is created having varying dimensions by the moving surface deformations 7 formed in the bottom surface 6 of the revolving member 5. Through the varying volume pressure pulses are generated, which are transferred into the outlet channel and are breaking up a fluid jet ejecting from the outlet channel 4. Typical dimensions of the deformations are in the order of the outlet channel 4 dimension, for instance a deformation height of 20-1000 micron, more preferably 20-300 micron. In FIG. 1, the revolving member 5 is illustrated schematically having a central bearing 17 around which the revolving member 5 rotates. Further driving means, such as a driver shaft and drive motor are illustrated in subsequent figures.

The outlet channel 4 is included in a relatively thin nozzle plate 8 which can be a plate manufactured from metal foil, of a thickness of 0.3 mm in this example. The outlet channel 4 in the plate 8 has a diameter of 50 μm in this example. A transverse dimension of the outlet channel 4 can be in the interval of 2-500 μm, more preferably in the order of 5-250 micron, even more preferably between 5-100 micron. As an indication of the size of the pressure regulating range, it may serve as an example that at an average pressure in the order of magnitude of 0.5-600 bars [$\equiv 0.5\text{-}600 \times 10^5$ Pa]. The printhead 1 may be further provided with a supporting plate (not shown) which supports the nozzle plate 8, so that it does not collapse under the high pressure in the chamber.

Figure 2:
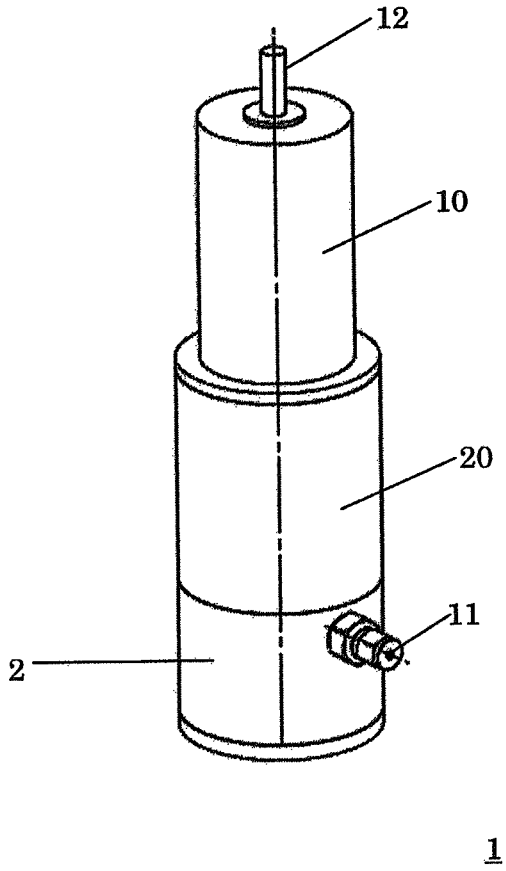
FIG. 2 shows schematically a perspective view of the droplet break up device according to the invention.

FIG. 2 schematically shows a perspective view of the printhead 1 according to an embodiment of the invention. The device 1 comprises a drive motor 10 arranged adjacent the chamber 2 of the droplet break up device via a bearing section 20. The chamber 2 comprises a print fluid inlet 11 arranged for receiving pressurized printing fluid. The drive motor 10 is, in this exemplary embodiment, a rotating electrical motor having an shaft 12 that extends to the chamber 2 and connects to the revolving member 5 illustrated in FIG. 1. Alternatively, the drive motor may be provided as part of the revolving member 5 and/or via a magnet coupling, for example, when seals are not preferred. When processing hot printing liquids, for example, molten metal at temperatures ranging from 700-1200° C., the shaft extension may provide a thermal barrier protecting the drive motor 10 from excessive heating.

Figure 3:
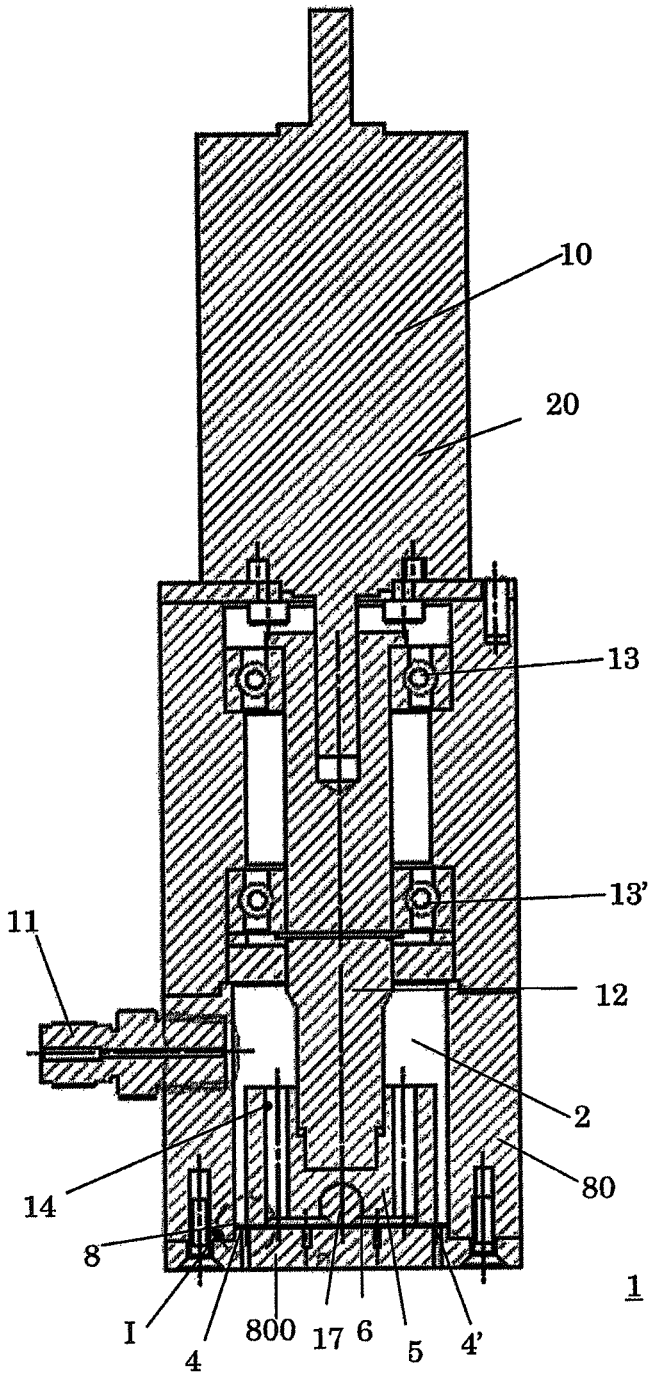
FIG. 3 shows schematically a cross-sectional view of the droplet break up device of FIG. 2.

FIG. 3 shows in more detail a crossectional view of the droplet break up device 1 illustrated in FIG. 2. In particular a drive motor 10 is shown to have a rotation shaft 12 extending through the chamber 2 via a sealing bearing 13, 13'. The fluid inlet 11 is shown to be in contact with chamber 2 and revolving member 5 is illustrated coupled to the rotation shaft 12. Chamber 2 and bearing section 20 are sealed with respect to each other by means of a seal. A nozzle plate 8, supported by supporting plate 800 is provided secured to a wall 80 of the chamber 2. Fluid outlets 4, 4' are illustrated opposite revolving member 5. Rested against central ball-bearing 17 a small space 15 is created (see FIG. 4.) by a recessed bottom surface 6 of the revolving member 5. Alternative to the ball-bearing, a fluid bearing may be envisioned. The recessed bottom surface 6 is in fluid connection with the rest of the chamber 2 via through holes 14. The trough holes function to equalize a pressure near the outlet channels 4, 4' and may reduce the axial forces on the revolving member 5.

Figure 4:
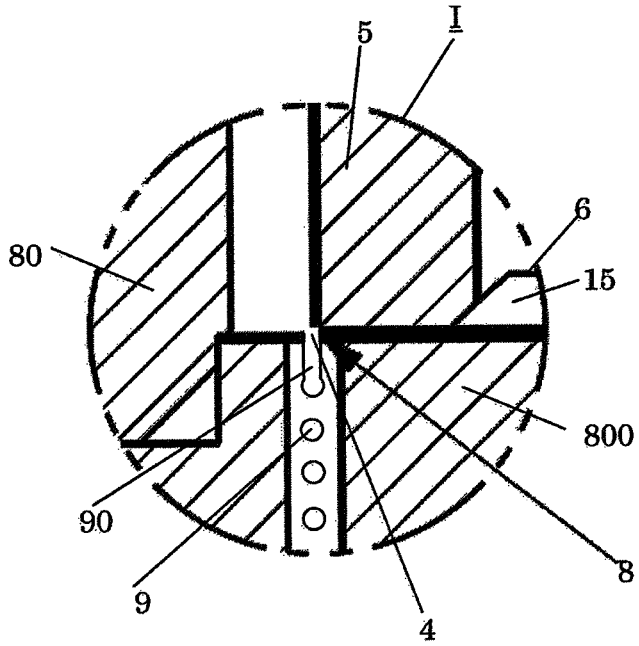
FIG. 4 shows schematically a detail of the view in FIG. 3.

FIG. 4 shows schematic detail I of FIG. 3. Shown is a schematically recessed area 15 formed by bottom surface 6 of the revolving member 5. In addition it is shown how the revolving member 5 interrupedly provides a closure to the outlet channel 4. In the embodiment is shown that the revolving member 5 is slidingly connected to the bottom wall 8. Alternatively, the revolving member may be a little distanced from the bottom plate 8, in a range of 0-500 micron. Larger distances facilitate fluid communication with the chamber 2 but diminish a pulse magnitude. As an exemplary illustration the dimensions of the outlet channel 4 can be in an interval of 2-500 micron, preferably in the order of 5-250 micron, even more preferably between 5-100 micron, depending on the printing liquid substances 3 and the desired droplet size, which may be well below 50 micron. In addition the nozzle plate 8 can be of a thickness ranging from 0.1-3 millimeter, defining an outlet channel length of outlet channel 4.

Figure 5:
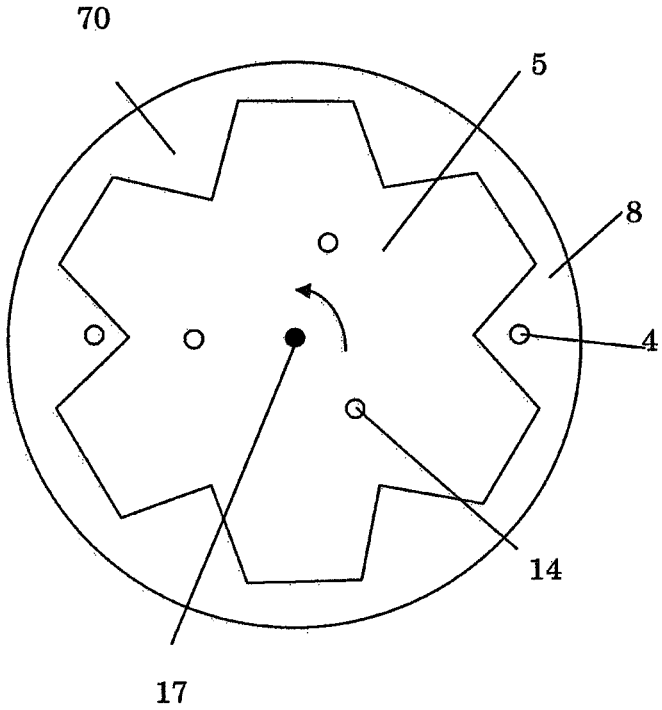
FIG. 5 shows a schematic top view of the revolving member according to an embodiment of the invention.

FIG. 5 shows a topview of the revolving member 5 according to an embodiment of the invention. It is shown that the deformations in the bottom surface area are provided as a notches 70, as an alternative to depressions 7 illustrated in FIG. 1. Also other forms are possible such as corrugations, protrusions, depressions or through holes in the revolving member 5, typically a disk or annulus. In one aspect of the invention a method of ejecting droplets 9 shown, see FIG. 1, for printing purposes, comprising providing a chamber 2 for containing a pressure liquid 3, the chamber comprising a bottom plate 8, and an outlet channel 4. In addition to pressurizing the printing liquid, pressure pulses are imparted to the liquid near the outlet channel 4 to break up a fluid jetted out of the outlet channel. According to an aspect of the invention the pressure pulse is imparted through a rotation induced jet disturbance. Through rotation, jet pulse frequencies may be attained well above 20 kHz, which can be multiplied by having multiple deformations on the revolving member 5.

Figure 6:
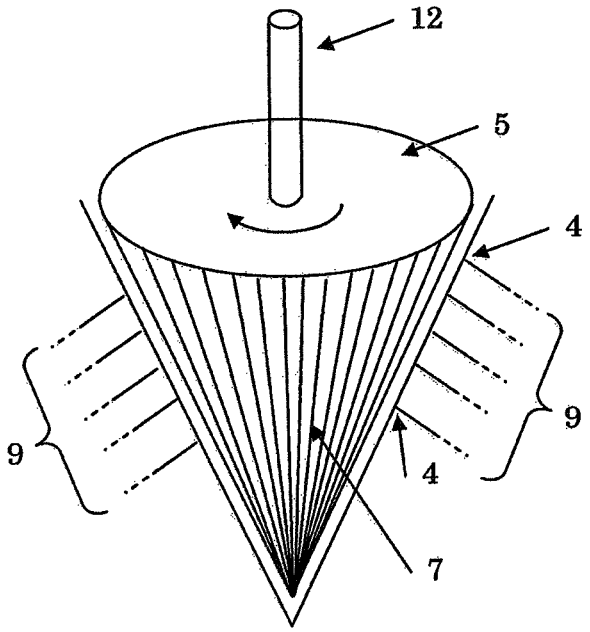
FIG. 6 shows a schematic side view of a further embodiment according to the invention.

FIG. 6 shows a schematic perspective side view of a further embodiment of the invention, wherein the revolving member is formed as a conical rotating member 5 having depressions or grooves 7. This embodiment has as an advantage that it directs the outlet channels 4 in diverging directions, which can be useful, for example, in industrial spray-drying applications where large volumes of sprays are generated. The number of outlet channels 4 can be multiplied along a circumference of the cone 5, which may be 5-500 mm in diameter. For example the number of channels may range from 10-500 and along a height of the cone 5, for example, 20-100 outlets, making large volume production feasible in a simple cost effective way. The height of the cone may range along several centimeters, for example, 2-10 cm.

It is noted that the number of grooves 7 along a circumference directly multiply the break-up frequency, so that for example, at a rotation speed of 8000 rpm, with 400 grooves a droplet frequency of over 53 khz can be obtained. The rotation speed may be well between 500-20000 rpm and the number of grooves may be between 5 and 1000, reaching breakup frequencies well above 20 kHz.

The invention has been described on the basis of an exemplary embodiment, but is not in any way limited to this embodiment. In particular, the scope of the invention includes all forms of droplet generation, for example, for spray drying, rapid prototyping or other printing applications. Diverse variations also falling within the scope of the invention are possible. To be considered, for instance, are the provision of regulatable heating element for heating the viscous printing liquid in the channel, for instance, in a temperature range of 15-1300° C. By regulating the temperature of the fluid, the fluid can acquire a particular viscosity for the purpose of processing (printing). This makes it possible to print viscous fluids such as different kinds of plastic and also metals (such as solder).

The invention claimed is:

1. A droplet break up device comprising:

a chamber for containing a pressurized printing liquid;

at least one outlet channel, provided in said chamber for ejecting the pressurized printing liquid out of the outlet channel as a fluid jet; and an actuator for breaking up the fluid jet;

wherein the actuator comprises a revolving member arranged opposite the at least one outlet channel, the revolving member comprising a surface deformation shaped to provide a pressure pulse near the at least one outlet channel;

wherein the chamber comprises a nozzle plate secured to a wall of the chamber and supported by a support plate;

wherein the at least one outlet channel is provided in the nozzle plate, and wherein the at least one outlet channel and the surface deformation are dimensioned so as to break up the fluid jet into droplets ejected from the outlet channel by pressure pulses transferred into the at least one outlet channel.

2. The droplet break up device according to claim 1, wherein the revolving member is a single revolving member including a plurality of surface deformations; and wherein a plurality of outlet channels is provided opposite the single revolving member.

3. The droplet break up device according to claim 1, wherein the revolving member includes:

a peripheral zone, the surface deformation being a plurality of surface deformations arranged in the peripheral zone; and a central depression to equalize a pressure near the at least one outlet channel.

4. The droplet break up device according to claim 3, wherein the central depression includes through holes connecting to the chamber.

5. The droplet break up device according to claim 3, wherein the central depression is formed to include a central bearing of the revolving member.

6. The droplet break up device according to claim 1, wherein the deformation is taken from the group of deformation types consisting of: depressions, protrusions, through holes and notches in an annular disk.

7. The droplet break up device according to claim 1, wherein the surface deformation comprises a plurality of deformations are arranged circularly.

8. The droplet break up device according to claim 1, wherein the revolving member is actuated by a rotation shaft extending through the chamber, the rotation shaft being coupled to a drive motor arranged adjacent to the chamber via a seal.

9. The droplet break up device according to claim 1, wherein the revolving member is annular and slidingly connected to a bottom wall of the chamber.

10. The droplet break up device according to claim 1, wherein the revolving member is conical in shape, and wherein the at least one outlet channel comprises a plurality of outlet channels that extend in diverging directions.

11. The droplet break up device according to claim 1, wherein a diameter of the at least one outlet channel is in the interval of 2-500 micron.

12. The droplet break up device according to claim 1, wherein a length of the at least one outlet channel is in the interval of 0.1-3 millimeter.

13. The droplet break up device according to claim 1, wherein the surface deformation comprises a plurality of surface deformations numbering larger than 5; and wherein a rotation speed of the revolving member is larger 500 rpm.

14. A method of ejecting droplets, comprising:

providing a chamber for containing a printing liquid and comprising an outlet channel;

pressurizing the printing liquid;

imparting a pressure pulse to the pressurized liquid near the outlet channel so as to break up a fluid jet, ejected from the outlet channel, into droplets; and wherein the pressure pulse is imparted through a disturbance induced by a rotation of a revolving member arranged within the chamber, the revolving member comprising a surface deformation, wherein the chamber comprises a nozzle plate secured to a wall of the chamber and supported by a support plate, said outlet channel being provided in the nozzle plate, wherein the fluid jet is broken up into droplets ejected from the outlet channel by pressure pulses transferred into the outlet channel, and wherein the outlet channel and the surface deformation are dimensioned so as to break up the fluid jet into the droplets ejected from the outlet channel.

15. The droplet break up device according to claim 1, wherein a diameter of the outlet channel is in the order of 5-250 microns.

16. The droplet break up device according to claim 1, wherein a diameter of the outlet channel is in the order of 5-100 microns.

17. The droplet break up device according to claim 1, wherein the surface deformation comprises a plurality of surface deformations numbering larger than 100; and wherein a rotation speed of the revolving member is larger than 500 rpm.

18. The droplet break up device according to claim 1, wherein the surface deformation comprises a plurality of surface deformations numbering larger than 100; and wherein a rotation speed of the revolving member is larger than 5000 rpm.

19. The droplet break up device according to claim 1, wherein the surface deformation comprises a plurality of surface deformations numbering larger than 5; and wherein a rotation speed of the revolving member is larger than 5000 rpm.

20. The method according to claim 14, wherein the fluid jet is broken-up at a breakup frequency of at least 20 kHz.

21. The droplet break up device according to claim 1, wherein the actuator comprising the revolving member is configured to break up the fluid jet at a breakup frequency of at least 20 kHz.

* * * * *